US009491992B2

(12) United States Patent
Kaltenrieder et al.

(10) Patent No.: US 9,491,992 B2
(45) Date of Patent: Nov. 15, 2016

(54) BRACELET CLASP

(71) Applicant: The Swatch Group Research and Development Ltd, Marin (CH)

(72) Inventors: Cedric Kaltenrieder, Courtelary (CH); Jean-Marc Von Allmen, Boudry (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/014,545

(22) Filed: Feb. 3, 2016

(65) Prior Publication Data

US 2016/0270492 A1 Sep. 22, 2016

(30) Foreign Application Priority Data

Mar. 18, 2015 (EP) ..... 15159729

(51) Int. Cl.
*A44C 5/24* (2006.01)
*A44C 5/14* (2006.01)

(52) U.S. Cl.
CPC . *A44C 5/24* (2013.01); *A44C 5/14* (2013.01); *Y10T 24/2155* (2015.01); *Y10T 24/4745* (2015.01)

(58) Field of Classification Search
CPC ..... A44C 5/24; A44C 5/14; Y10T 25/2155; Y10T 25/4745
See application file for complete search history.

(56) References Cited

U.S. PATENT DOCUMENTS

| | | | |
|---|---|---|---|
| 1,832,734 | A | 11/1931 | Prestinari |
| 2012/0240359 | A1 | 9/2012 | Kaltenrieder |

FOREIGN PATENT DOCUMENTS

| | | | |
|---|---|---|---|
| CH | 689 931 | A5 | 2/2000 |
| EP | 0 913 106 | A1 | 5/1999 |
| EP | 2 502 515 | A1 | 9/2012 |
| JP | 2008-289638 | | 12/2008 |

OTHER PUBLICATIONS

European Search Report issued Sep. 24, 2015 in European Application 15159729, filed on Mar. 18, 2015 (with English Translation).

*Primary Examiner* — Abigail Morrell
(74) *Attorney, Agent, or Firm* — Oblon, McClelland, Maier & Neustadt, L.L.P.

(57) ABSTRACT

A bracelet clasp including three strips, and a cover hinged to one of the strips. The clasp is provided with first and second push-pieces and with a safety device preventing lateral movement of the cover causing the clasp to unlock when pressure is simultaneously exerted on the push-pieces. The safety device includes a spacer being received between the cover flaps, the ends of the spacer abutting against the cover flaps so as to prevent lateral movement of the cover causing the clasp to unlock when pressure is simultaneously exerted both on a push-piece and on a flap of the cover opposite the push-piece.

12 Claims, 4 Drawing Sheets

BRACELET CLASP

This application claims priority from European Patent Application No. 15159729.1 filed on Mar. 18, 2015, the entire disclosure of which is hereby incorporated herein by reference.

FIELD OF THE INVENTION

The invention relates to a bracelet clasp, and particularly to watch bracelets or straps.

BACKGROUND OF THE INVENTION

There is known, from U.S. Pat. No. 1,832,734, a clasp including a cover and two push-pieces whose axis of extension does not coincide with the hinge axis of the cover. However, an application of pressure on a single push-piece accompanied by a simultaneous application of pressure on one side of the cover opposite the push-piece opens the clasp, which is absolutely unacceptable in the eyes of the Applicant of the present invention.

There is also known, from EP Patent No 0913106, a folding clasp including a rigid base provided with two side members, a cover arranged to be attached to a bracelet strand, and at least one folding arm having a rear end attached to one end of the base by a first hinge and having a front end attached to the cover by a second hinge. The folding arm includes two juxtaposed branches provided with push-pieces, and whose front ends are held apart by an elastic element. Such a clasp has the same aforecited drawback: the cover has too much play, thus allowing the clasp to be opened by application of pressure on a single push-piece accompanied by simultaneous pressure on one side of the cover opposite the push-piece.

SUMMARY OF THE INVENTION

It is an object of the present invention to overcome all or part of the aforecited drawbacks by providing a clasp that meets safety requirements and prevents the clasp from opening easily.

It is another object of the invention to provide a clasp that keeps the cover in place when the clasp is in a closed position, and prevents the strand attached to the cover from unfastening.

It is also an object of the invention to provide a clasp that is simple and economical to produce.

To this end, the invention relates to a bracelet clasp including:

- a first rigid strip, a first end of which is hinged on a first end of a second folding strip configured to receive a first bracelet strand at its second end, and a second end of the first strip is hinged on a first end of a third unfolding strip from which extend first and second branches to which is hinged, about an arbor, a cover provided with first and second flaps extending perpendicularly with respect to the cover, and means for holding a second bracelet strand, the third strip partially covering the second end of the second strip when the clasp is in a closed position,
- first and second push-pieces integral with the first and second branches,
- a locking mechanism configured to keep the third strip locked on the first strip when pressure is not simultaneously exerted on the push-pieces,

- a safety device preventing rotation of the cover about the arbor in the counterclockwise direction causing the release of the second strand from the holding means if an attempt is made to open the cover when the clasp is in the closed position.

According to the invention, the safety device includes:

- a spacer housed between the cover flaps, the ends of the spacer abutting against the cover flaps,
- stop members configured to cooperate with the spacer to prevent rotation of the cover about the arbor when the clasp is in the closed position.

As a result of these features, such a clasp offers increased security against attempted theft, the safety device preventing lateral movement of the cover causing the clasp to unlock when pressure is simultaneously exerted both on a push piece and on a flap of the cover opposite said push piece.

In accordance with other advantageous variants of the invention:

- the stop members are formed in the flaps;
- the stop members are each formed by a recess each including an opening for passage of the spacer;
- the ends of the spacer abut in the recesses of the cover flaps to prevent a lateral movement of the cover causing the clasp to unlock when pressure is simultaneously exerted both on a push piece and on a flap of the cover opposite said push piece;
- the spacer is carried by the second strip;
- the spacer is fixed to the second end of the second strip;
- the spacer is used as an anchorage point for the first bracelet strand;
- the clasp includes locking means for holding the second strip locked against the first strip when the clasp is in a closed position;
- the locking mechanism includes, on the one hand, a first pair of catches integral with the first strip, and on the other hand, a second pair of catches integral with the third strip;
- the second pair of catches is integral with the branches;
- the branches are laterally flexible on all or part of the length thereof.

The invention also concerns a wristwatch including a bracelet provided with a clasp according to the invention.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

A bracelet clasp according to a first embodiment will now be described below with reference jointly to FIGS. 1, 2, 3, 4 and 5. This first embodiment is known and described as prior art useful for comprehension of the invention.

Figure 1:
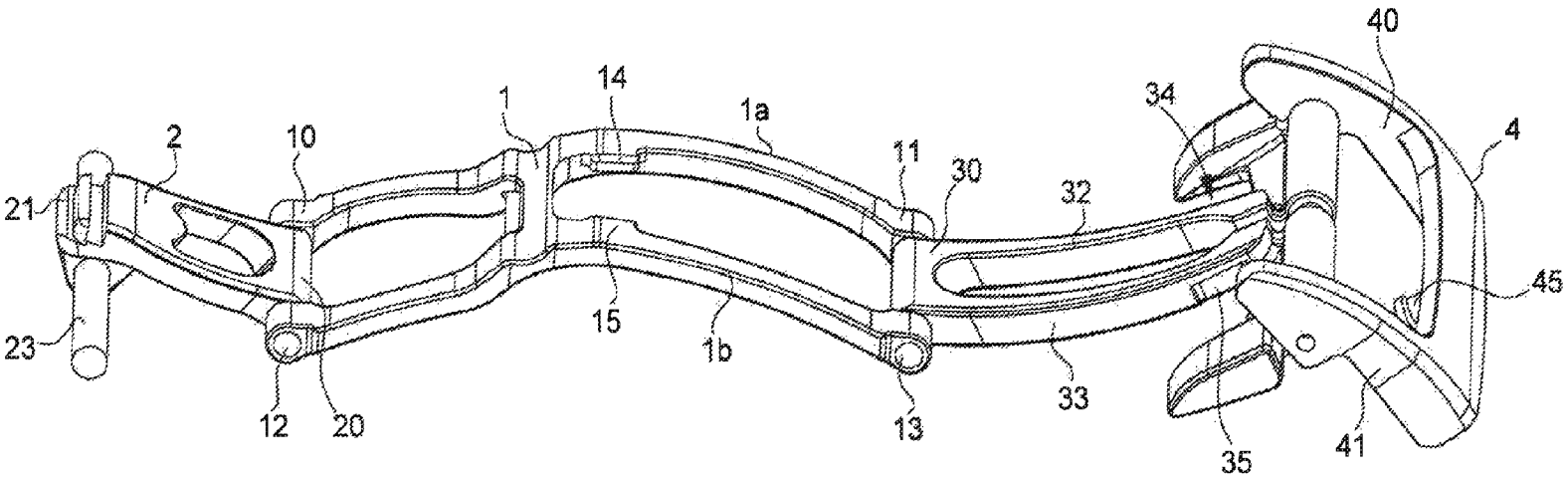
FIG. 1 is a perspective view of a clasp according to a first embodiment of the invention.
Figure 5:
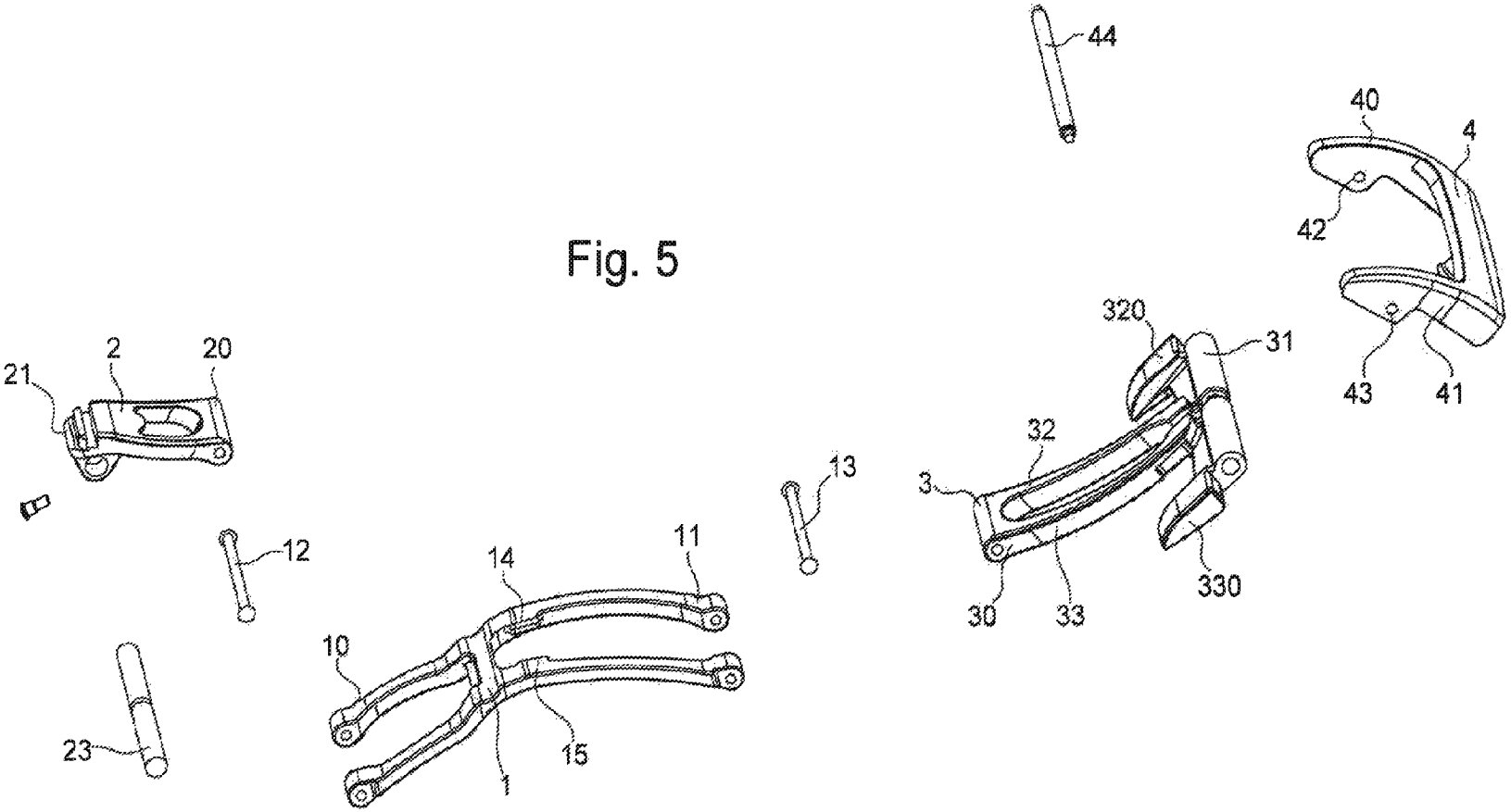
FIG. 5 is an exploded view of a clasp according to a first embodiment of the invention.

FIGS. 1 and 5 are perspective views of the bracelet clasp which includes a first rigid strip 1, provided with two side members 1*a* and 1*b* connected to each other by a bridge. A first end 10 of this strip is hinged to a first end 20 of a second folding strip 2 by means of an arbor 12. This second strip 2 is configured to receive a first bracelet strand at its second end 21 by means of an arbor 23.

The other end 11 of first strip 1 is hinged to a first end 30 of a third folding strip 3, third strip 3 partially covering the second end 21 of second strip 2 when the clasp is in a closed position.

First and second branches 32 and 33, which are movable in translation, emerge from first end 30 of third strip 3. According to a variant of the invention, not shown in the Figures, first strip 1 may be solid and have a receptacle including locking means configured to receive branches 32 and 33.

The clasp also includes a cover 4, hinged to branches 32 and 33, provided with first and second flaps 40 and 41 extending perpendicularly with respect to cover 4. Flaps 40 and 41 have holes 42 and 43 configured to receive the ends of an arbor 44 to form the hinge between branches 32 and 33 and cover 4.

Cover 4 may have means for holding a second bracelet strand, such as a pin 45 as illustrated in the Figures or a bar, to define a starting point for the second bracelet strand. FIGS. 3 and 5 also show first and second push-pieces 320 and 330 which are integral with the first and second branches 32 and 33. According to the embodiment illustrated in FIGS. 1 to 5, push-pieces 320 and 330 are not placed in the alignment of arbor 44 traversing branches 32 and 33, but precede this alignment. According to another embodiment, push-pieces 320 and 330 may be in the alignment of arbor 44.

A locking mechanism is arranged to keep third strip 3 locked on first strip 1 when pressure is not simultaneously exerted on push pieces 320 and 330. To this end, side members 1*a* and 1*b* of first strip 1 respectively have fixed catches 14 and 15 configured to cooperate respectively with catches 34 and 35 disposed on branches 32 and 33. This arrangement of catches can be observed in FIG. 3.

According to the invention, the clasp includes a safety device preventing lateral movement of cover 4 causing the clasp to unlock inadvertently when pressure is simultaneously exerted both on a push-piece 320 or 330 and on a flap 40 or 41 of cover 4 opposite said push-piece.

As can be observed in the Figures, the actual safety device takes the form of a spacer 23 disposed at the second end 21 of second strip 2, spacer 23 being received between flaps 40 and 41 of cover 4 when the clasp is in a closed position.

The operation of the safety device will now be explained.

In FIG. 3, push-pieces 320 and 330 are not actuated and the locking of the clasp is shown, with catches 14 and 15 of side members 1*a* and 1*b* respectively cooperating with catches 34 and 35 of branches 32 and 33.

Figure 2:
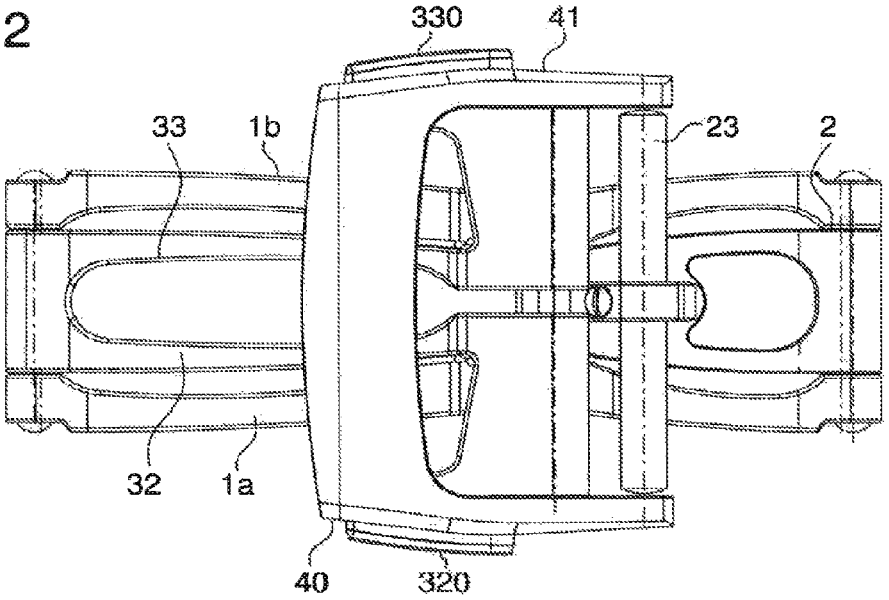
FIG. 2 is a top view of a clasp according to a first embodiment of the invention.
Figure 3:
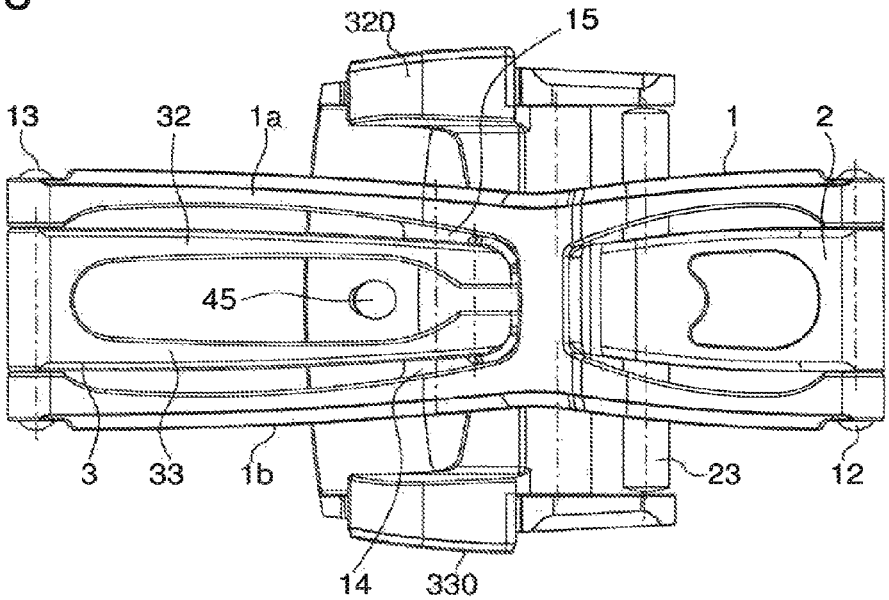
FIG. 3 is a bottom view of a clasp according to a first embodiment of the invention.
Figure 4:
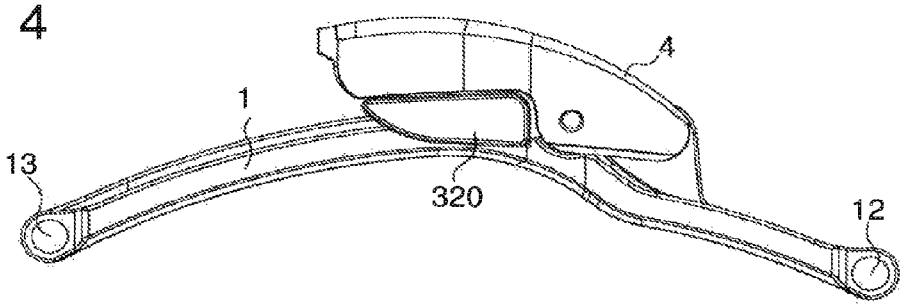
FIG. 4 is a side view of a clasp according to a first embodiment of the invention.

When the clasp is folded as in FIG. 2, each end of spacer 23 respectively abuts against each flap 40 and 41 of cover 4 when pressure is exerted on one of flaps 40 or 41 of cover 4, which prevents any deformation of flaps 40 and 41.

When identical pressure is exerted at the same time on push-piece 320 and on flap 41 of cover 4, this does not cause the clasp to unlock owing to the safety device fitted thereto. In a closed position, spacer 23 abuts against the inner wall of flaps 40 and 41 of cover 4. It will be understood that if the spacer 23 did not exist, the pressure exerted on flap 41 of cover 4 would cause movement of the latter and of branch 33, thereby also releasing catches 15 and 33. The same situation would arise if the other push-piece 321 were actuated and if pressure were exerted on the other flap 40 of cover 4.

In conclusion, in order to open the clasp, pressure must be simultaneously exerted on both push-pieces, and pressure exerted on the cover has no effect. When push-pieces 320 and 330 are actuated, catches 34 and 35 of branches 32 and 33 are released from catches 14 and 15 of side members 1*a* and 1*b*, thereby causing third strip 3 to be released and the clasp to open.

A bracelet clasp according to a second embodiment will now be described below with reference jointly to FIGS. 6*a*, 6*b*, 6*c* and 7.

Figure 6A:
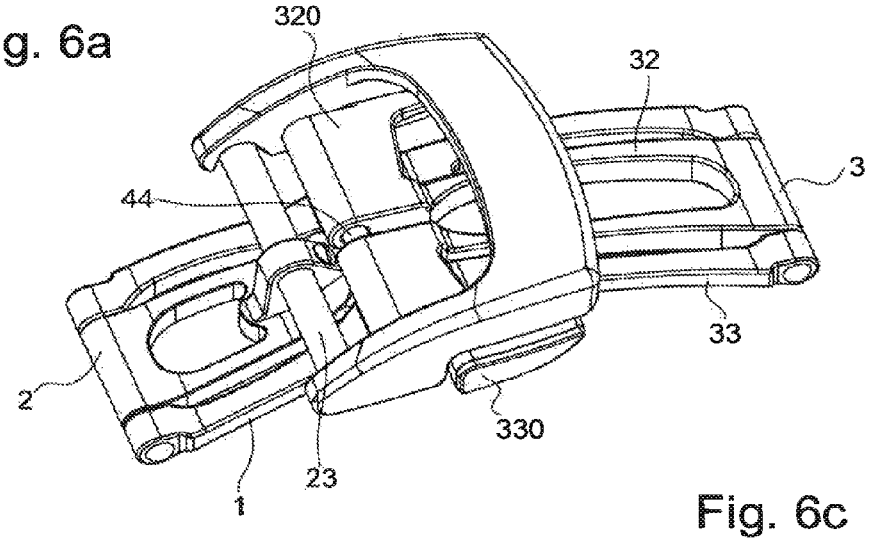
FIGS. 6*a* to 6*c* respectively illustrate a clasp according to a second embodiment of the invention, showing a top and a bottom view of the cover of the clasp according to the second embodiment.

FIG. 6*a* is a perspective view of the bracelet clasp according to the second embodiment, which includes a first rigid strip 1, provided with two side members 1*a* and 1*b* connected to each other by a bridge. A first end 10 of this strip is hinged to a first end 20 of a second folding strip 2 by means of an arbor 12. This second strip 2 is configured to receive a first bracelet strand at its second end 21 by means of an arbor 23.

The other end 11 of first strip 1 is hinged to a first end 30 of a third folding strip 3, third strip 3 partially covering the second end 21 of second strip 2 when the clasp is in a closed position.

First and second branches 32 and 33, which are movable in translation, emerge from first end 30 of third strip 3. The clasp also includes a cover 4, hinged to branches 32 and 33, provided with first and second flaps 40 and 41 extending perpendicularly with respect to cover 4. Flaps 40 and 41 have holes 42 and 43 configured to receive the ends of an arbor 44 to form the hinge between branches 32 and 33 and cover 4.

Figure 6B:
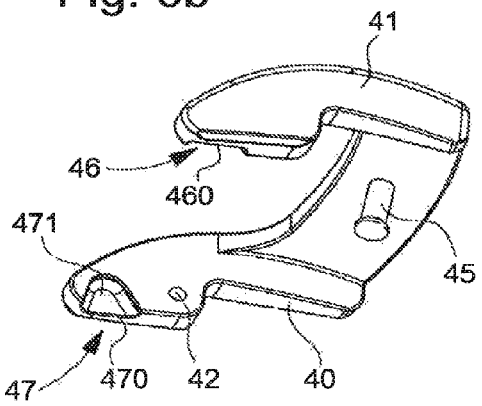
Figure 6C:
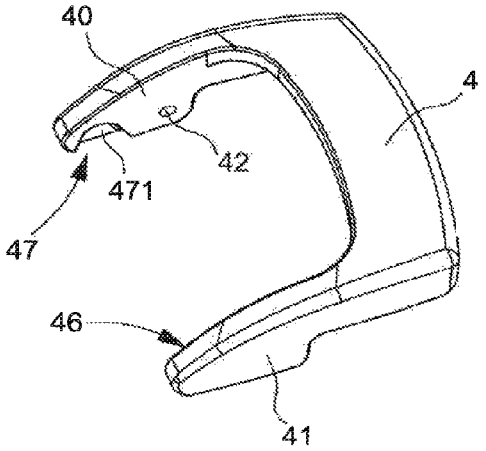
Figure 7:
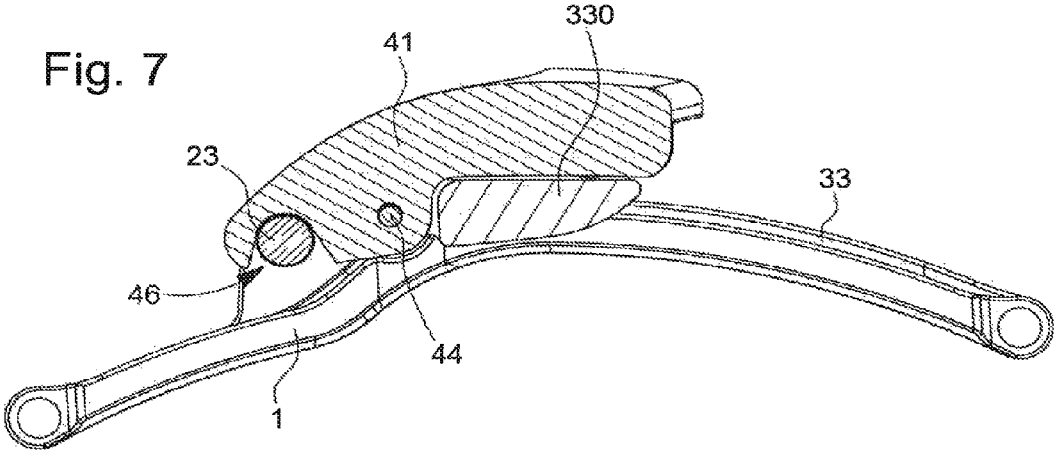
FIG. 7 is a sectional view of a clasp according to a second embodiment of the invention.

As can be observed in FIGS. 6*b* and 6*c*, cover 4 includes stop members formed in flaps 40 and 41 and configured to cooperate with spacer 23 of the safety device to prevent rotation of cover 4 about arbor 44 in the counterclockwise direction when the clasp is in a closed position.

The stop members are formed by recesses 46 and 47 including a downwardly directed opening 460 and 480, i.e. towards the clasp strips, so that the ends of spacer 23 can be inserted in recesses 46 and 47. As can be observed in FIG. 7, the end of spacer 23 is housed in recess 46 and thus blocks the opening of cover 4. Indeed, the latter can no longer pivot in the counterclockwise direction about arbor 44, and can no longer pivot in the clockwise direction, since push pieces 320 and 330 block cover 4 when the clasp is in the closed position.

Advantageously, recesses 46 and 47 both block rotation of cover 4 when the clasp is closed, with spacer 23 abutting against the bottom 461, 471 of recesses 46 and 47 if someone attempts to lift cover 4 when the clasp is in the closed position, and also each end of spacer 23 respectively abuts against each of the walls of recesses 46 and 47 formed in cover flaps 40 and 41, which prevents any deformation of flaps 40 and 41 of cover 4 when pressure is exerted on one of flaps 40 or 41.

According to an alternative embodiment, not shown in the Figures, recesses 46 and 47 are arranged to be open such that spacer 34 traverses each of flaps 40 and 41 of cover 4.

Again, according to an alternative embodiment not shown in the Figures, spacer 23 may include at each end thereof a spring loaded ball, each spring loaded ball being configured to cooperate with hemisphere-shaped recesses 46 and 47.

Of course, this invention is not limited to the illustrated example but is capable of various variants and alterations that will appear to those skilled in the art.

LIST OF PARTS

1 First strip
10 First end of the first strip
11 Second end of the first strip
12 Arbor
13 Arbor
14, 15 First pair of catches
2 Second strip
20 First end of the second strip
21 Second end of the second strip
23 Spacer
3 Third strip,
30 First end of the third strip
31 Second end of the third strip
32, 33 Branches
34, 35 Second pair of catches
320, 330 Push-pieces
4 Cover
40, 41 Cover flaps
42, 43 Holes
44 Arbor
45 Pin
46, 47 Recesses
460, 470 Openings
461, 471 Recess bottom

What is claimed is:

1. A bracelet clasp comprising:

a first rigid strip, wherein a first end is hinged on a first end of a second folding strip configured to receive a first bracelet strand at the second end thereof, and wherein a second end of the first strip is hinged on a first end of a third folding strip from which extend first and second branches to which is hinged, about an arbor, a cover provided with first and second flaps extending perpendicularly with respect to the cover, and means for holding a second bracelet strand, the third strip partially covering the second end of the second strip when the clasp is in a closed position, first and second push-pieces integral with the first and second branches, a locking mechanism configured to hold the third strip locked on the first strip when pressure is not simultaneously exerted on the push-pieces, a safety device preventing rotation of the cover about the arbor in the counterclockwise direction causing the release of the second strand from the holding means if an attempt is made to open the cover when the clasp is in the closed position, wherein the safety device comprises:

a spacer housed between the flaps of the cover, the ends of the spacer abutting against the flaps of the cover, stop members configured to cooperate with the spacer to prevent rotation of the cover about the arbor when the clasp is in the closed position.

2. The bracelet clasp according to claim 1, wherein the stop members are formed in the flaps.

3. The bracelet clasp according to claim 1, wherein the stop members are each formed by a recess each including an opening for passage of the spacer.

4. The bracelet clasp according to claim 3, wherein the ends of the spacer abut in the recesses of the flaps of the cover to prevent a lateral movement of the cover causing the clasp to unlock when pressure is simultaneously exerted both on a push piece and on a flap of the cover opposite said push piece.

5. The bracelet clasp according to claim 1, wherein the spacer is carried by the second strip.

6. The bracelet clasp according to claim 1, wherein the spacer is fixed to the second end of the second strip.

7. The bracelet clasp according to claim 1, wherein the spacer is used as an anchorage point for the first bracelet strand.

8. The bracelet clasp according to claim 1, including locking means for keeping the second strip locked against the first strip when the clasp is in the closed position.

9. The bracelet clasp according to claim 1, wherein the locking mechanism includes, on the one hand, a first pair of catches integral with the first strip, and on the other hand, a second pair of catches integral with the third strip.

10. The bracelet clasp according to claim 9, wherein the second pair of catches is integral with the branches.

11. The bracelet clasp according to claim 1, wherein the branches are laterally flexible over all or part of the length thereof.

12. A wristwatch comprising a bracelet provided with the bracelet clasp according to claim 1.

* * * * *